United States Patent [19]

Koch et al.

[11] 4,365,652

[45] Dec. 28, 1982

[54] CROSSING THREAD SUPPLY SYSTEM FOR A WEAVING MACHINE

[75] Inventors: Bernhard R. Koch, Horgenberg; Erich Vogelbacher, Horgen, both of Switzerland

[73] Assignee: Sulzer Brothers Limited, Winterthur, Switzerland

[21] Appl. No.: 177,357

[22] Filed: Aug. 11, 1980

[30] Foreign Application Priority Data

Aug. 16, 1979 [EP] European Pat. Off. ..... 79102987.9

[51] Int. Cl.[3] ..... D03C 7/04

[52] U.S. Cl. ..... 139/50; 139/54

[58] Field of Search ..... 139/48, 50, 54, 429, 139/430

[56] References Cited

U.S. PATENT DOCUMENTS 2,703,587 3/1955 Allenson ..... 139/54

3,880,199 4/1975 Riha et al. ..... 139/54

FOREIGN PATENT DOCUMENTS 761630 9/1980 U.S.S.R. ..... 139/54

*Primary Examiner*—Henry Jaudon

*Attorney, Agent, or Firm*—Kenyon & Kenyon

[57] ABSTRACT

The crossing thread supply system has four bobbin pairs which are disposed on rotatable disk-shaped elements. Each bobbin pair is guided downwardly through a tube which rotates with a respective rotatable element in non-rotatable relative relation. The tube extends obliquely so that all of the tubes deliver the respective thread pairs to twisting disks located in a relatively narrow lane.

11 Claims, 5 Drawing Figures

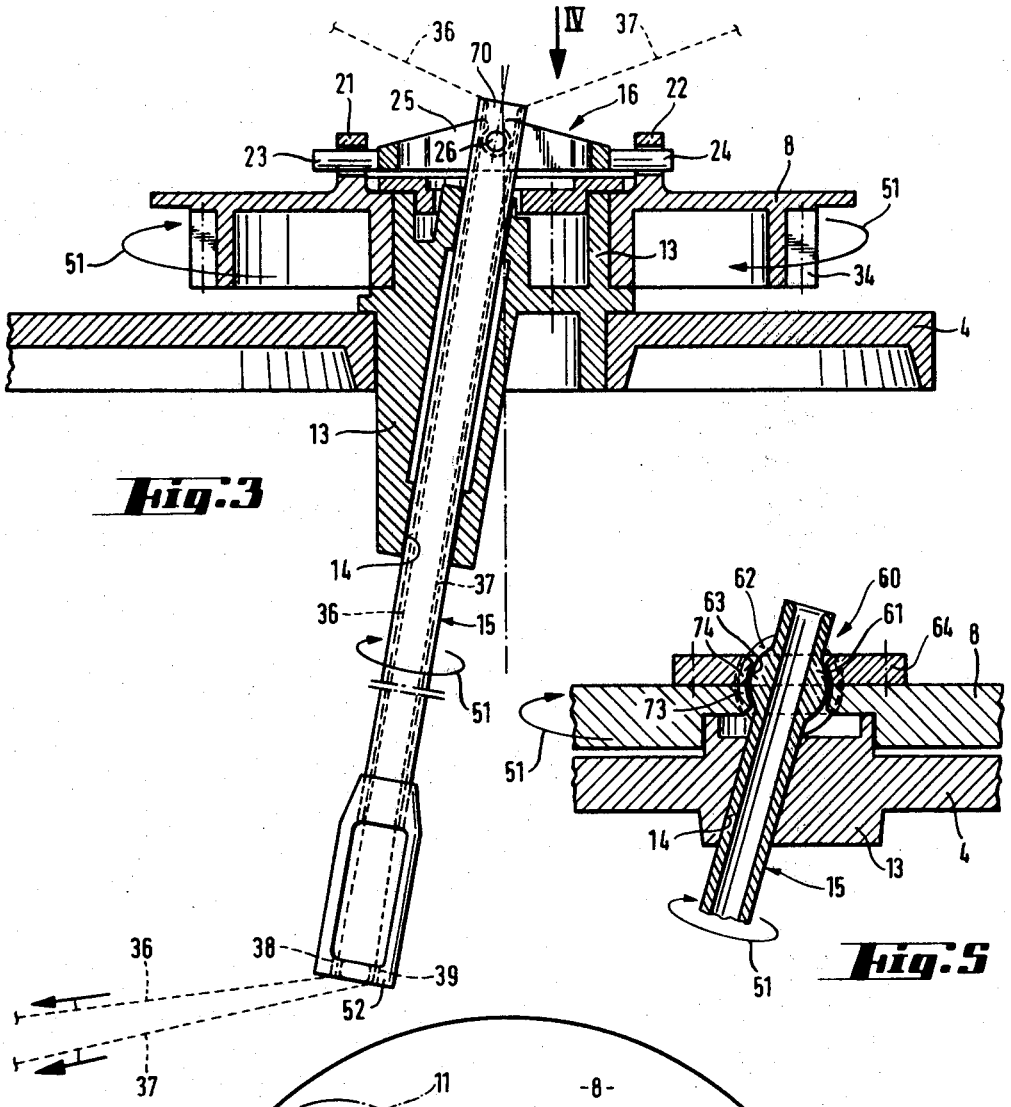
Fig. 3
Fig. 5
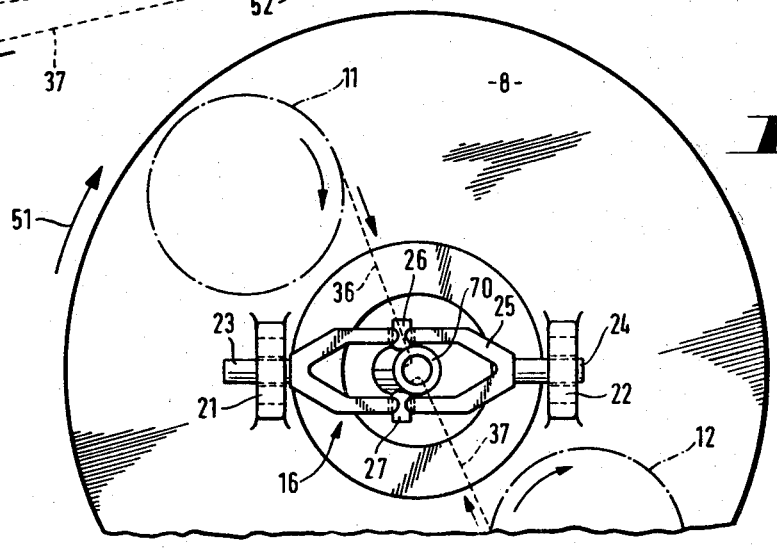
Fig. 4

CROSSING THREAD SUPPLY SYSTEM FOR A WEAVING MACHINE

This invention relates to a crossing thread supply system. More particularly, this invention relates to a crossing thread supply system for a weaving machine.

As is known, various types of crossing thread supply systems have been provided for weaving machines. In one known system, for example as described in Swiss Pat. No. 575,027, a single thread reserve bobbin pair is disposed on a rotating disk on which a downwardly directed distributor mandrel for twisting two threads is mounted. In such a system, the threads which are unwound from the bobbin pair are guided to a twisting system downstream of the mandrel for subsequent passage into a shed of a weaving machine.

However, a fixed connection of the distributor mandrel and the bobbin supporting disk shaped element has not been suitable for crossing thread supply systems which require multiple, for example four, thread reserve bobbin pairs wherein each bobbin pair is disposed on a separate rotatable element. This is because the four associated crossing thread pairs which are guided downwardly would leave the respective distributor mandrels at four points located at the four corners of a square. As a result, a relatively large distance would exist between the lower ends of the four mandrels. Thus, the four crossing thread pairs would be guided under an unfavorable angle to associated twisting systems, for example composed of twisting disks. Also, an unfavorable thread entrance or thread exit angle would result at the twisting systems along with increased friction between the threads and the associated twisting disk. In addition, the twisting disks would have to be spaced at such a distance from each other that a relatively wide warp-thread-free lane would form in the warp.

Accordingly, it is an object of the invention to provide a crossing thread supply system wherein a multiplicity of thread pairs can be directed to twisting systems in a relatively simple manner.

It is another object of the invention to provide a crossing thread supply system for supplying a multiplicity of thread pairs within a narrow path.

It is another object of the invention to provide a crossing thread supply system for a multiplicity of pairs of threads of a relatively simple construction.

It is another object of the invention to provide a relatively simple means of guiding a multiplicity of thread pairs to twisting disks over small angles.

It is another object of the invention to reduce the friction occurring between guided pairs of thread and twisting disks in a crossing thread supply system.

Briefly, the invention provides a crossing thread supply system for a weaving machine which is comprised of at least one rotatable disk-shaped element, a thread reserve bobbin pair mounted on the element, a thread twisting mandrel extending from the element for receiving and twisting a pair of threads from the bobbin pair upon rotation of the element, a non-rotational joint between the mandrel and element to prevent relative rotation between the mandrel and the element, and a twisting system for receiving the pair of threads from the mandrel for passage to a shed in a weaving machine.

The non-rotational joint may be a Cardan joint or a ball and socket joint. In the latter case, a spherical member is provided on one of the mandrel and rotatable element while a bearing shell is provided on the other of the mandrel and rotatable element. In addition, each of the spherical member and bearing shell has a serration which mates with a serration on the other in order to prevent relative rotation therebetween.

In one embodiment, the crossing thread supply system has a multiplicity, for example four, thread reserve bobbin pairs therein. In this embodiment, the system has a stationary base plate on which a plurality of rotatable disk-shaped elements are rotatably mounted. Each element, in turn, carries a bobbin pair and has a thread twisting mandrel in the form of a tube extending therefrom obliquely through the base plate for receiving and twisting a pair of threads. In addition, the system includes a twisting system having a plurality of twisting disks while each tube has a lower end disposed in the plane of the twisting discs.

The construction of the supply system is such that each twisting mandrel can be rotated on its axis during operation while being retained at an oblique angle. Thus, the free end of each mandrel can be positioned in the plane of an associated twisting disk. Also, the twisting disks and the lower ends of the mandrels can be disposed in closely spaced relation. Guidance of the crossing threads leaving the supply system can, therefore, be especially reliable while friction is reduced to a minimum.

Because the associated twisting disks can be positioned in a side-by-side relation with a minimum of spacing, a relatively narrow warp thread-free lane can be provided in the warp for the positioning of the twisting disks.

These and other objects and advantages of the invention will become more apparent from the following detailed description taken in conjunction with the accompanying drawings in which:

FIG. 1 schematically illustrates a side view of a crossing thread supply system constructed in accordance with the invention;

FIG. 3 illustrates a view taken on line III—III of FIG. 2;

FIG. 4 illustrates a top view taken in the direction of the arrow IV in FIG. 3; and FIG. 5 illustrates a modified joint between a rotatable element and a tube in accordance with the invention.

Figure 1:
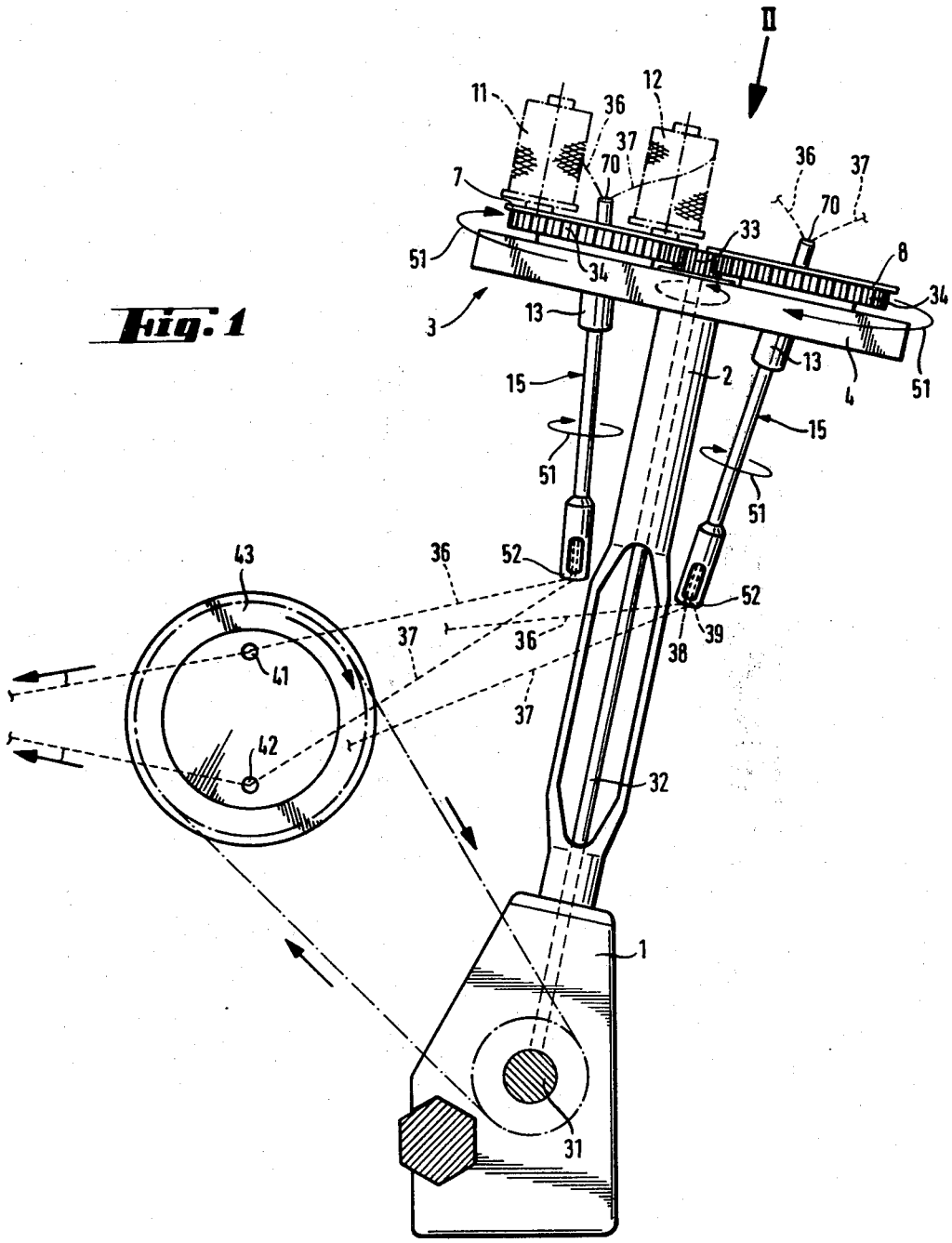

Referring to FIG. 1, the crossing thread supply system 3 is mounted via a support 2 on a bearing portion 1 of a weaving machine which is not otherwise illustrated. The crossing thread supply system 3 contains a stationary base plate 4 on which a plurality (e.g. four) of rotatable disk-shaped elements 5–8 are rotatably mounted via four stationary bearing parts 13 (see FIG. 3). Each element 5–8, in turn, carries a thread reserve bobbin pair 11, 12 while each bearing part 13 contains an oblique bore 14 in which a thread twisting mandrel or tube 15 is mounted to extend from a rotatable element 5–8.

As indicated in FIG. 3, each tube 15 extends from a respective element 5–8 obliquely through a bearing part 13 of the base plate 4 to receive and twist a pair of threads from the respective bobbin pair 11, 12 upon rotation of the element 5–8. As shown, a non-rotational joint 16 in the form of a Cardan joint is disposed between an upper end 70 of each tube 15 and the respective element 5–8 in order to suspend the tube from the element 5–8 while preventing relative rotation therebetween. Each joint 16 contains two bearings 21, 22 which are formed on an element 5–8 to receive two pins 23, 24 of a Cardan frame 25 in pivotal relation with play. In addition, the frame 25 (see FIG. 4) receives two pins 26, 27, with play, which are fastened on the tube 15.

Referring to FIG. 1, the weaving machine includes a drive shaft 31 which passes through the bearing portion 1. This drive shaft 31 is coupled to a shaft 32 which extends through the support 2 and terminates at a pinion 33 at the upper end. The pinion 33, in turn, meshes with toothed rims 34 which are connected to each of two of the rotatable elements 7, 8. In addition, the pinion 33 meshes with a pinion 35 which is rotatably mounted on the plate 4 and meshes with toothed rims 34 on the remaining elements 5, 6. Thus, the shaft 32 is able to drive the elements 5–8 in unison.

Figure 2:
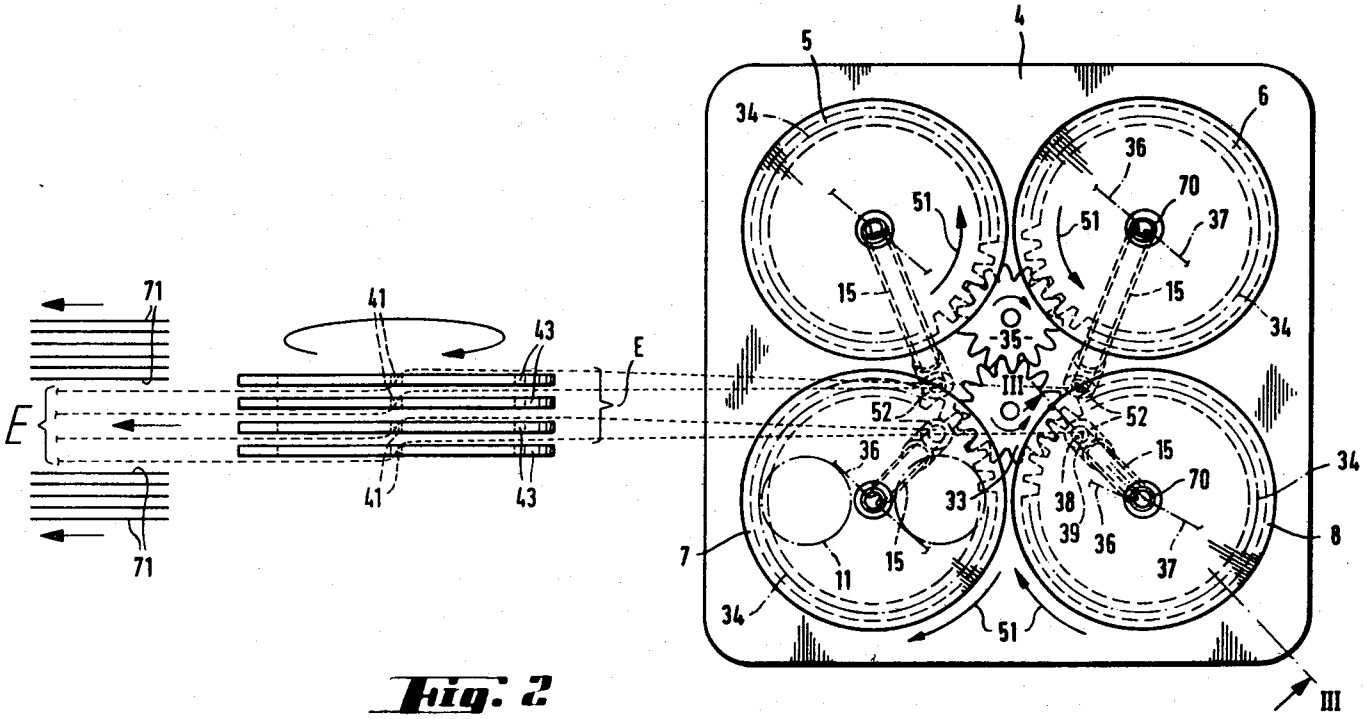
FIG. 2 illustrates a top view of the supply system of FIG. 1.

The crossing thread supply system 3 also has a twisting system which includes a plurality of twisting disks 43. As shown in FIG. 1, each disk 43 has a pair of eyelets 41, 42 for receiving the threads of a bobbin pair. Also, as shown in FIG. 2, the twisting disks 43 are disposed in a plane E which forms a narrow lane within the warp threads 71 for forming a shed in the weaving machine. The disks 43 are driven from the main drive shaft 31 as indicated in FIG. 1.

During operation, the drive shaft 31 is set in rotation synchronously to the main shaft of the weaving machine. The shaft 31, in turn, drives the shaft 32 and, thus, the elements 5–8. As a result, two associated crossing warp threads 36, 37 are drawn from each bobbin pair 11, 12. These warp threads 36, 37 are drawn from each bobbin pair 11, 12. These warp threads 36, 37 then pass into an opening at the upper end 70 of each associated tube 15 and extend downwardly through the tube 15 to exit via eyelets 38, 39 at the bottom (see FIG. 3) for travel to the eyelets 41, 42 of an associated twisting disk 43. During this time, the associated tubes 15 rotate in the directions indicated by the arrows 51 while the disks 43 rotate in the direction indicated by the respective arrows.

Because the tubes 15 are suspended via the Cardan joints 16, even though the tubes 15 rotate with the elements 5–8, the tubes 15 always maintain the same oblique position as shown in FIGS. 2 and 3. Thus, the lower end 52 of each tube 15 can be retained in the plane E of the twisting disks 43. As a result, thread friction is largely eliminated and the crossing threads can be guided into the shed of the weaving machine over the respective twisting disks 43.

In a modified embodiment, only two bobbin pairs 11, 12 are provided on associated support disks 5, 8. In this case, the associate tubes 15 can, due to the suspension by means of a Cardan joint 16 and the oblique position via the bearing part 13, always be held during operation at the lower ends 52 in the plane E of the respective twisting disks 43.

Referring to FIG. 5, wherein like reference characters indicate like parts as above, the non-rotational joint may be in the form of a ball and socket joint. In this case, a spherical member 61 is provided on the tube 15 while a mating bearing shell is provided about the spherical member 61. As indicated, the bearing shell is a two part member with one part 73 formed on the element 5–8 and a second part 74 formed by a cover plate 64 secured to the element 5–8. In addition, the spherical portion 61 has a serration 62 which extends from top to bottom and which is distributed about the circumference of the member 61. This serration 62 mates with a corresponding serration 63 in the parts 73, 74 of the bearing shell.

The ball and socket joint thus permits the tube 15 to be pivoted relative to the element 5–8 while preventing relative rotation therebetween during joint rotation in the direction indicated by the arrow 51.

As shown, the bearing part 13 is integral with the base plate 4.

The invention thus provides a crossing thread supply system in which a multiplicity of bobbin pairs can deliver pairs of threads with a minimum of friction. In addition, a relatively narrow warp thread-free lane can be provided in the warp used to form a shed in a weaving machine. Still further, the twisting disks of the twisting system can be positioned with a minimum of spacing between each other.

What is claimed is:

1. A crossing thread supply system for a weaving machine comprising at least one rotatable disk-shaped element;

a stationary bearing part having said disk-shaped element rotatably mounted thereon and an oblique bore extending therethrough;

a thread reserve bobbin pair mounted on said element;

a thread twisting tube extending from said element through said bore for receiving and twisting a pair of threads from said bobbin pair upon rotation of said element;

a non-rotational joint between said mandrel and said element to prevent relative rotation between said mandrel and said element; and a twisting system for receiving the pair of threads from said mandrel for passage to a shed in a weaving machine.

2. A system as set forth in claim 1 wherein said joint is a cardan joint.

3. A system as set forth in claim 1 wherein said joint is a ball and socket joint including a spherical member on one of said mandrel and said element and a bearing shell on the other of said mandrel and said element, each of said spherical member and said bearing shell having a serration mating with a serration of the other of said member and shell.

4. A system as set forth in claim 1 wherein said twisting system includes at least one twisting disk and said mandrel has a lower end disposed in a plane common to said twisting disk.

5. A crossing thread supply system for a weaving machine comprising a stationary base plate;

a plurality of rotatable disk-shaped elements rotatably mounted on said plate;

a plurality of thread reserve bobbin pairs, each said bobbin pair being mounted on a respective element;

a plurality of thread twisting tubes, each said tube extending from a respective rotatable element obliquely through said base plate for receiving and twisting a pair of threads from a respective bobbin pair upon rotation of said respective element; and a twisting system for receiving each pair of threads from a respective tube for passage to a weaving machine.

6. A system as set forth in claim 5 which further comprises a plurality of non-rotational joints, each said joint being disposed between a respective tube and respective element to prevent relative rotation therebetween.

7. A system as set forth in claim 6 wherein said base plate has a plurality of bearing parts mounted thereon, each said part having an oblique bore extending therethrough with a respective tube therein.

8. A system as set forth in claim 6 wherein said twisting system includes a plurality of twisting disks, disposed in a given plane, and wherein each said tube has a lower end disposed in said plane.

9. A system as set forth in claim 5 wherein said twisting system includes a plurality of twisting disks disposed in a given plane, and wherein each said tube has a lower end disposed in said plane.

10. A crossing thread supply system for a weaving machine comprising at least one rotatable disk-shaped element;

a thread reserve bobbin pair mounted on said element;

a thread twisting mandrel extending from said element for receiving and twisting a pair of threads from said bobbin pair upon rotation of said element;

a cardan joint between said mandrel and said element to prevent relative rotation between said mandrel and said element; and a twisting system for receiving the pair of threads from said mandrel for passage to a shed in a weaving machine.

11. A crossing thread supply system for a weaving machine comprising at least one rotatable disk-shaped element;

a thread reserve bobbin pair mounted on said element;

a thread twisting mandrel extending from said element for receiving and twisting a pair of threads from said bobbin pair upon rotation of said element;

a non-rotational ball and socket joint between said mandrel and said element to prevent relative rotation between said mandrel and said element, said joint including a spherical member on one of said mandrel and said element and a bearing shell on the other of said mandrel and said element, each of said spherical member and said bearing shell having a serration mating with a serration of the other of said member and shell; and a twisting system for receiving the pair of threads from said mandrel for passage to a shed in a weaving machine.

* * * * *